US005488809A

United States Patent [19]

Lindsay

[11] Patent Number: 5,488,809

[45] Date of Patent: Feb. 6, 1996

[54] MODULAR UNIFIED FLOOR ASSEMBLY INCORPORATING WOODEN GIRDER BEAM WITH OPTIONAL PREFORMED STAIRWELL OPENING

[75] Inventor: Fredrick H. Lindsay, Seminole, Fla.

[73] Assignee: Lindsay Industries, Inc., Seminole, Fla.

[21] Appl. No.: 272,066

[22] Filed: Jul. 8, 1994

[51] Int. Cl.[6] ..... E04H 12/00

[52] U.S. Cl. ..... 52/653.1; 52/143; 52/650.1

[58] Field of Search ..... 52/653.1, 654.1, 52/650.1, 650.2, 143, 480, 650.3, 690, 693; 280/789; 296/204

[56] References Cited

U.S. PATENT DOCUMENTS 4,019,299 4/1977 Lindsay ..... 52/650.3
4,930,809 6/1990 Lindsay .
5,028,072 7/1991 Lindsay .
5,201,546 4/1993 Lindsay .
5,245,802 9/1993 Davis ..... 52/36.4

*Primary Examiner*—Kien T. Nguyen
*Attorney, Agent, or Firm*—Lowe, Price, LeBlanc & Becker

[57] ABSTRACT

A lightweight, strong, economically-manufactured, and safely transportable modular unified floor assembly includes a lengthwise wooden girder beam formed with male and female ends to facilitate cooperative integration thereby to another similar floor assembly. In another aspect of the invention, the floor assembly is manufactured with a stairwell opening of selected size and at a selected location. The floor assembly even with a stairwell opening according to this invention is strong enough to be transported comfortably and safely from its point of manufacture to the site at which it is to be located for use.

20 Claims, 4 Drawing Sheets

MODULAR UNIFIED FLOOR ASSEMBLY INCORPORATING WOODEN GIRDER BEAM WITH OPTIONAL PREFORMED STAIRWELL OPENING

FIELD OF THE INVENTION

This invention relates to a modular unified floor assembly suitable for towed transport from a manufacturing facility to the site where it is to be used, and more particularly to such a unified floor assembly which incorporates a cost-efficient longitudinal wooden girder beam and provides an optional preformed reinforced stairway opening.

BACKGROUND OF THE RELEVANT ART

A variety of unified floor assemblies, incorporating varying amounts of wood and steel and suitable for specific purposes, are known. These include manufactured unified floor assemblies, of a type readily towed on public highways to a selected site for use, as taught in my patents U.S. Pat. Nos. 4,930,809, 5,028,072, and 5,201,546.

The goal is to provide an economically-manufactured, strong but light, conveniently transportable floor assembly which can be cooperatively mounted on site with one or more other similar floor assemblies as part of a building structure. There are numerous advantages in manufacturing floor assemblies in this manner, including uniform quality control, economies of scale in manufacture, optimum utilization of skilled and trained manpower, and the facility for precisely customizing product to suit the needs of individual customers. The use of lengthwise steel beams in such floor assemblies provide strength but may add to the weight and costs more than wood. It is therefore desirable to minimize the use of steel in such floor assemblies. This is best accomplished by judiciously combining wood and steel.

One increasingly common use for such manufactured floor assemblies is in forming the ground level floors of building structures that have basements. It is not uncommon nowadays to have each floor assembly of fairly large size, e.g., such as to provide a useful floor area of the order of 14 ft.×40 ft. or longer. The resulting floor structures typically are supported either on upright basement walls or on metal or masonry posts disposed where two immediately adjacent floor assemblies come together and are connected to provide a large continuous useful floor.

Such floor assemblies typically provide a floor at an upper surface and also a lower surface which can inherently serve as a ceiling for the basement portion of the finished structure. As in all floors, there is in such floor assemblies a vertical spacing between the uppermost horizontal surface which serves as the floor for the space above the floor assembly and the lowermost horizontal surface which usually serves as the ceiling for the basement portion of the finished structure. By suitable selection of the dimensions of this space it becomes possible during the process of manufacturing the floor assembly to include ventilation ducting, piping, electrical power telephone lines, wiring, and the like, for easy connection to sources of warm or cold air, hot or cold water, and the usual electrical power and telephone lines from outside, respectively.

Uniformity of the finished product and high quality control are readily realized where the manufacturing of the floor assembly and its innards takes place under a roof rather than in the open as is common in forming floor structures on site in the open and when exposed to inclement weather conditions.

As noted, for different needs it is desirable to have particularized structural features. One such need is for a floor assembly having a precisely-dimensioned preformed opening for the location of a stairway. As persons of ordinary skill in the art will appreciate, the formation of such a hole in a floor assembly of conventional type can generate a structural weakness which can become a serious problem when the manufactured floor assembly is towed at typical highway speeds over uneven road surfaces. Such an opening must therefore be properly reinforced when the floor assembly is manufactured, i.e., before it is towed away.

There is, therefore, a clear need for a lightweight, reasonably priced, modular floor assembly which allows an architectural designer to specify an opening for a stairway leading downwardly from the floor on site. The present invention is particularly suited to meet this need.

SUMMARY OF THE INVENTION

Accordingly, it is a principal object of this invention to provide in a preferred embodiment a unified floor assembly employing a relatively long, lightweight, strong, longitudinal wooden girder beam.

It is a related object of this invention to provide a modular unified floor assembly which is lightweight, strong and reasonably priced, and which incorporates a lengthwise wooden girder beam formed to facilitate cooperating disposition in use with another similar modular floor assembly to generate extensive floor structures with provision for ventilation ducting, piping and wiring included within.

It is another object of this invention to provide a lightweight, economically-manufactured, unified floor assembly which includes a preformed opening for a stairway.

These and other related objects of this invention are realized by providing a modular unified floor assembly having a longitudinal axis, which includes a longitudinal first interior beam means parallel to the longitudinal axis for providing interior support and a longitudinal second interior beam means also parallel to the longitudinal axis and on an opposite side thereof relative to the first beam means, for providing additional interior support. The floor assembly also includes an exterior longitudinal rail means which is disposed parallel to the longitudinal axis and provides longitudinal support and defines a first longitudinal perimeter portion of the floor assembly. A longitudinal girder beam having numerous openings to accommodate utility elements and to reduce weight is disposed parallel to the axis and on an opposite of the floor assembly to the rail means, for providing longitudinal support and defining a second longitudinal perimeter portion of the floor assembly. The structure also includes a plurality of transverse truss means each connected to the side rail means at a first end, to the girder beam at a second end, and to the first and second interior beam means respectively intermediate the first and second ends.

In another aspect of this invention, the floor assembly as described in the immediately preceding paragraph is modified by making the second interior beam means in two collinear portions separated by a first gap corresponding to a longitudinal side of a stairwell disposed therebetween, and in the plurality of transverse truss means including at least one shortened truss means which extends from a first end connected to the rail means, past the first interior beam means and connected thereto, to a second end which is intermediate the first and second beam means, the second end being separated from the girder beam by a second gap corresponding to a transverse side of the stairwell disposed therebetween.

To obtain extensive floor assembly structures, two of the above-described unified floor assemblies may be disposed in use so that their respective girder beams are immediately adjacent and connected to each other, the combined unified floor assemblies being supported underneath so that they are horizontal and at the same level.

In yet another aspect of this invention, each of the above-described unified floor assemblies has its girder beam formed so that it has a gap of selected width and length defined at a first end and an extension of corresponding width and length at an opposite end. Two such unified floor assemblies may be longitudinally connected to each other with the extension at the end of the girder beam of one unified floor assembly being fitted into the corresponding gap in the girder beam of the second unified floor assembly. Then, with the two unified floor assemblies each supported to be horizontal and at the same level, the combination of the two unified floor assemblies provides an extensive longitudinal combined floor assembly.

Persons of ordinary skill in the art can be expected to consider these and other equally obvious and advantageous ways of combining and supporting two or more such unified floor assemblies to suit particularized needs, e.g., for L-shaped floors, etc., upon understanding the detailed disclosure of the invention as provided below with reference to the accompanying drawing figures.

DETAILED DESCRIPTION OF THE PREFERRED EMBODIMENTS

The floor assembly is conveniently manufactured at a central facility where cost efficiencies are realized and uniform quality controls are exercised over the manufacturing process. The floor assembly is then mounted to a suitable wheeled carriage structure of known kind and towed behind a tractor vehicle over highways with the normal amount of shock-loading experienced in transit. A primary goal, therefore, is to form the floor assembly such that even when a stairwell opening is formed therein during manufacture the floor assembly will cope with all foreseeable shock loads which it will encounter before coming to rest at its final destination.

One way to obtain high strength in a floor assembly, is to selectively employ properly proportioned steel elements. This adds to the weight and cost, hence sophisticated structural analyses are performed and steel elements for support are employed only in places and in a manner deemed optimum in light of all the factors, e.g., ease of manufacture, weight, cost, and anticipated loading both during transportation and in its ultimate use. Thus, for example, a floor assembly which is expected to ultimately support rather heavy machinery, equipment, heavily-loaded shelves, etc., may need heavyduty steel elements. By contrast, a relatively small floor assembly for use in the living room of a dwelling may require less steel. In short, the amount, physical dimensions, and overall strength of any metal elements used in the floor assembly according to the preferred embodiments of this invention must be chosen in light of such factors. Persons of ordinary skill in the mechanical arts can be expected to make the necessary choices and decisions in the exercise of their normal professional skills, hence any dimensions discussed below are intended to be exemplary and not as limiting.

Figure 1:
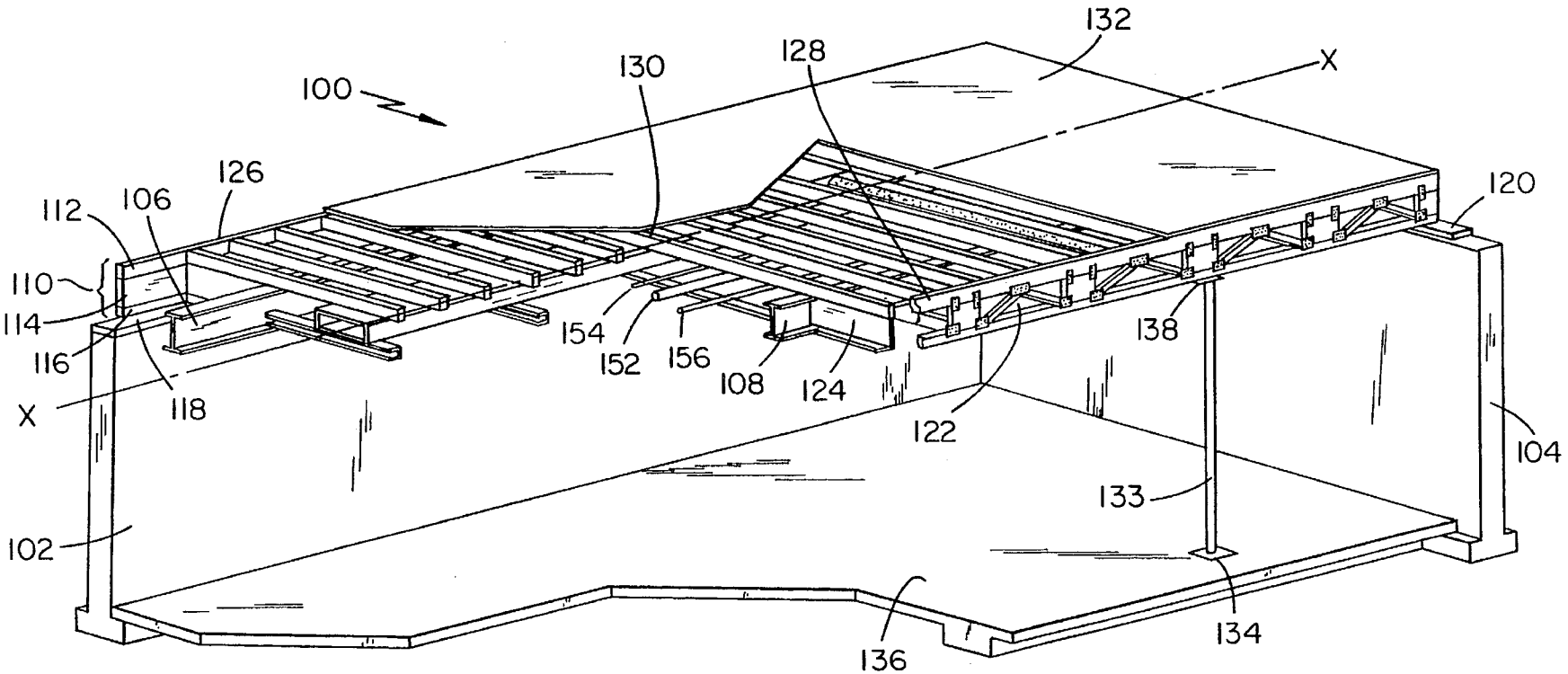
FIG. 1 is a fragmentary perspective view of a unified floor assembly partially supported along outer edges by vertical structural walls and supported elsewhere by an exemplary support post.

FIG. 1 is a fragmentary perspective view of a unified floor assembly according to a first preferred embodiment of this invention. This floor assembly 100 has a generally rectangular form with its length along a longitudinal axis X-X being greater than its width measured normal to this axis. This, however, is not intended to be definitive or limiting, and square floor assemblies may be manufactured in accordance with the present invention. However, when a rectangular form is selected, the finished floor assembly will likely be towed in a direction along the axis X-X. As can be expected, unevenness of the road surface will cause up-and-down movement of the towed floor assembly, generating external and inertial forces principally in a vertical plane. This will tend to cause bending or flexing of the floor assembly in a vertical plane, i.e., the front and back ends of the floor assembly will tend to move up and down relative to their unstressed positions. It is therefore necessary to provide strong longitudinal internal support to counter foreseeable shock-loading during transportation of the floor assembly from the point of manufacture to its ultimate site of use.

Even when the floor assembly 100 reaches its final destination, and is supported as indicated in FIG. 1 by upright vertical support walls such as 102 and 104 positioned along its outermost edge portions, the need for strong longitudinal internal support remains. For this reason, it is preferable, although not absolutely necessary, to employ elongate I-section steel beams 106 and 108 disposed parallel to and on opposite sides of axis X-X. These beams in the embodiment per FIG. 1 will extend without interruption for substantially the entire length of the floor assembly 100 if no stairwell opening is formed. As described below with reference to FIG. 2, the formation of a stairwell opening requires the inclusion of reinforcing elements to ensure against undue stressing and structural damage during transportation of the floor assembly and its subsequent use.

As generally indicated in FIG. 1, one elongate side of floor assembly 100 has the form of a side wall 110 comprising a plurality of elongate wood elements 112,114 and 116 stacked in a vertical relationship. Side wall 110 rests on an elongate, flat, horizontal sill plate 118 disposed over upright support wall 102. Similarly, immediately below a transverse end portion of floor assembly 100 there is provided another sill plate 120 at the top of upright support wall 104.

On an opposite side from side wall 110 and parallel thereto, the longitudinal edge portion of floor assembly 00 comprises a unique elongate girder beam 122 which, like side wall 110, extends the entire length of floor assembly 100.

Transversely of side wall 110 and girder beam 122 disposed parallel thereto, there is provided a plurality of transverse trusses 124, parallel to each other and each preferably perpendicular to longitudinal axis X-X. Each of these transverse trusses is formed of a plurality of cooperating components which is described more fully hereinbelow.

Side wall 110 has an uppermost longitudinal surface 26, longitudinal girder beam 122 has an uppermost longitudinal surface 128, and transverse trusses 124 each have an upper surface 130. When floor assembly 100 is properly supported, surfaces 126,128 and 130 are all in a common horizontal plane upon which is affixed flooring 132 which provides a smooth upper floor surface. Simultaneously, by its common connection to side wall 110, girder beam 122 and trusses 124, flooring 132 stiffens and unifies the overall structure and may comprise plywood, masonite, metal, or other suitable known material.

Although not clearly shown in FIG. 1, a layer of wood, e.g., plywood, may also be affixed to the respective lowermost surface of side wall 110, girder beam 122, and trusses 124, and could serve as a ceiling surface for the space underneath floor assembly 100. A conventional false ceiling could be suspended beneath floor assembly 100.

As indicated in FIG. 1, additional support may have to be provided to floor assembly 100 at suitable locations beneath girder beam 122 along the corresponding longitudinal side of the floor assembly. Such support may take the form of upright support posts such as 133 each resting on a post support plate 134 provided on a floor 136 beneath floor assembly 100. At the top of support post 133 there is preferably provided a load plate 138 to extend beneath the lowermost surface of floor assembly 100 directly under longitudinal girder beam 122. The number and separation of such posts must necessarily be related to the total weight to be imposed upon floor assembly 100 and the necessary choices may be readily made by persons of ordinary skill in the mechanical arts as needed.

As generally indicated earlier, steel I-section beams 106 and 108 could, under appropriate circumstances, be replaced by I-section beams made of wood. However, for relative large floor assemblies according to this invention, it is preferable to employ steel I-section beams such as 106 and 108 in FIG. 1.

Although it is not very clearly seen in FIG. 1, it will be readily understood that trusses such as 124 may be readily utilized to define the transverse ends of floor assembly 100, e.g., over transverse sill plate 120 above support wall 104, and in similar manner at an opposite transverse end (not shown in FIG. 1 for simplicity).

Figure 2:
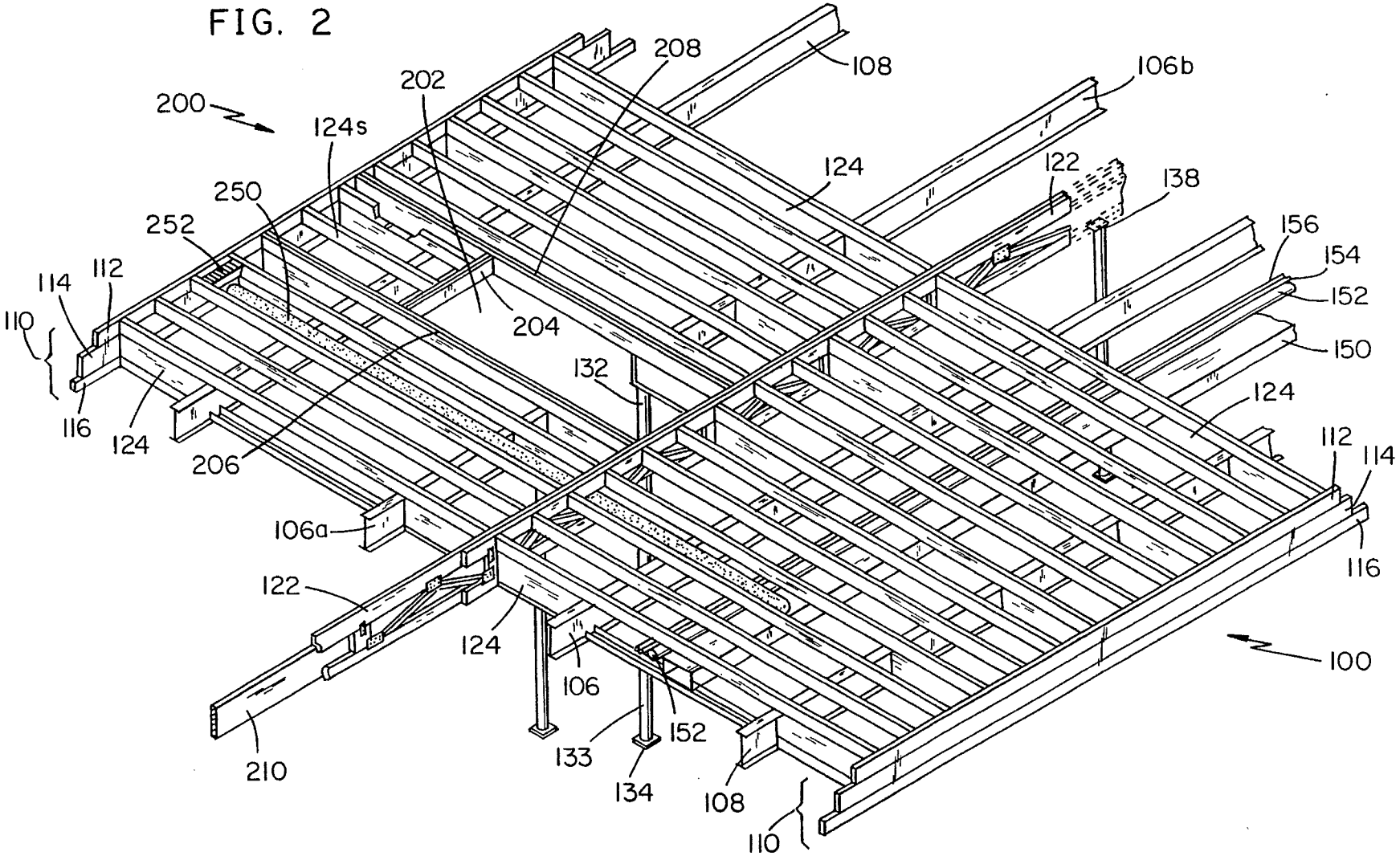
FIG. 2 is a partial perspective view of two side-by-side cooperating unified floor assemblies according to a preferred embodiment of this invention, one of the floor assemblies being manufactured with a rectangular, reinforced stairway opening.

As best seen in FIG. 2, assorted utility elements such as heating and/or air conditioning ducting 150, water pipe 152, and electric power and/or telephone wires 154, 156 may be installed within floor assembly 100 (or 200), at the time of manufacture, with conventional end fittings (not shown).

The floor assembly 100 illustrated in FIG. 1 includes no stairwell openings formed therein during manufacture. However, with some modification of the structure illustrated in FIG. 1 it becomes possible to provide another preferred embodiment, i.e., floor assembly 200, best seen in FIG. 2, which has a stairwell 202 formed therein during manufacture. Such a floor assembly 200 can be readily combined with a floor assembly 100 to provide an extended floor structure with a suitably located and sized stairwell 202. Note that floor assembly 200 is generally very similar to floor assembly 100, i.e., each has a longitudinal side wall or rail 110, a longitudinal girder beam 122 parallel thereto, a plurality of full width transverse trusses 124, and longitudinal interior beams 108.

Floor assembly 200, however, has a break in its interior longitudinal support beam 106. The two portions 106*a* and 106*b* are maintained to be collinear with each other and are separated by a distance corresponding to a dimension of stairwell opening 202 in a direction parallel to support beams 106*a* and 106*b*.

Correspondingly, at least one of the plurality of the transverse trusses 124 must be made shorter by an extent corresponding to a transversely-oriented dimension of stairwell opening 202. Such a shortened transverse truss 124*s*, like the other full width trusses 124, is joined to rail 110 (in a manner to be described in greater detail below), lies over the interior longitudinal support beam 108 and ends at and is connected to a reinforced longitudinally-oriented support element 204 which is itself connected at its ends to two reinforced transverse trusses 206 and 208.

The net consequence is that stairwell opening 204 is defined, as best seen in FIG. 2, by reinforced support element 204, reinforced transverse trusses 206 and 208, and at least a total thickness of the respective girder beams 122, 122 of floor assemblies 100 and 200 in the structure of FIG. 2. The reinforced support member 204 may be constituted of a double thickness of wood as illustrated in FIG. 2, and would have an uppermost surface parallel to that of guide rail 110 and the full width trusses 124. Similarly, the shortened truss 124s must be positioned so that its uppermost surface is parallel, i.e., coplanar, with the uppermost surfaces of side rail 110, full width trusses 124 and reinforced support element 204. The goal is to ensure that the flooring continues to be uniformly horizontal over the entire floor assembly 200 except for the stairwell.

Reinforcement of full width trusses 206 and 208 may be most readily realized by providing two trusses 124 side by side and firmly connected to each other, e.g., by nails or other suitable fastening elements.

In the structure illustrated in FIG. 2, comprising a floor assembly 100 (without a stairwell) and a floor assembly 200 (formed with a stairwell 202), the total thickness of the two girder beams 122, 122 provides the necessary reinforcement at the corresponding side of stairwell 202. However, to ensure that floor assembly 200 may be safely transported without suffering permanent damage due to transportation shock forces, a laminated beam 210 may be attached to that portion of girder beam 122 (of floor assembly 200) which corresponds to the stairwell. This laminated beam 210 may be of a width comparable to the vertical height of girder beam 122 and preferably has a length sufficient to extend past both sides of the stairwell to a distance sufficient to be attached to three adjacently separated successive full width trusses 124. The purpose of such a laminated beam 210 is two-fold: first, to ensure that there is added stiffness at the side of stairwell 202 corresponding to girder beam 122; and, secondly, to provide reinforcement where the double thickness, reinforced, full width trusses 206 and 208 connect to girder beam 122. It should be remembered that floor assembly 200 must be transported by itself to the final location and, therefore, that unless laminated beam 210 were thus provided the portion of girder beam 122 corresponding to the stairwell would be a singularly weakened point in the structure being transported. Persons of ordinary skill in the art would appreciate that the provision of laminated beam 210 of at least the dimensions discussed immediately above will not only strengthen floor assembly 200 around the stairwell but will add to the ability of the floor assembly 200 to withstand twisting or torque-related stresses which could well be encountered during transportation over uneven road surfaces.

The above-discussed reinforcement aspects are intended to be only exemplary, and persons of ordinary skill in the art upon becoming aware of the need to provide sufficient reinforcement can be expected to consider other alternatives, e.g., providing C-section metal channel members or the like in place of the second thicknesses of wood in support member 204 or full width reinforced trusses 206, 208. Such obvious variations are intended to be comprehended within this description, the principal goal being to ensure that even a relatively large floor assembly 200 can be transported safely so that it arrives to be used without suffering any loss of structural integrity or strength since its manufacture.

Figure 3:
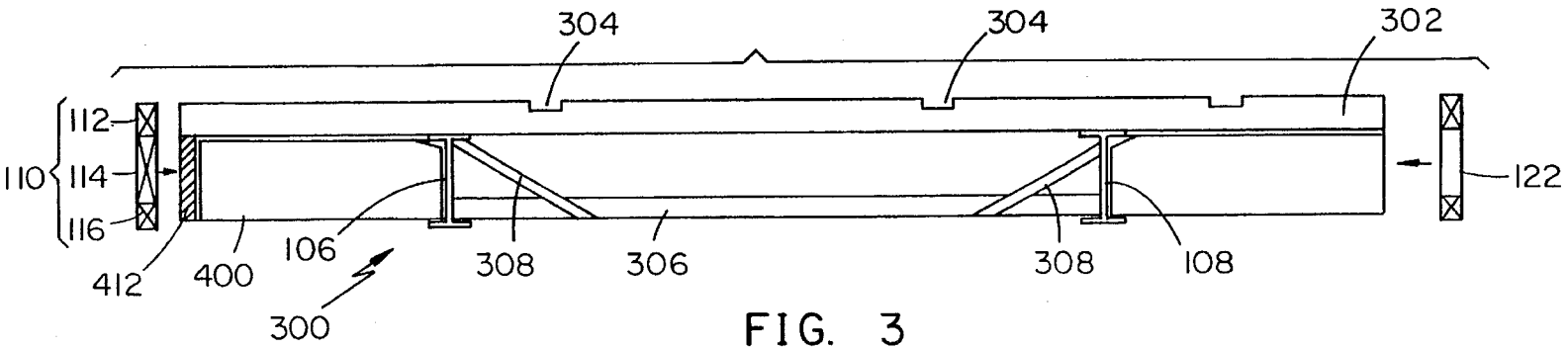
FIG. 3 is a partially-exploded vertical cross-sectional view of the principal elements forming a transverse truss in the unified floor assembly according to the preferred embodiment of FIG. 2.
Figure 5:
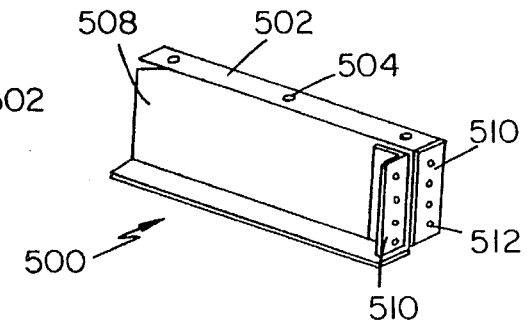
FIGS. 4, 5, and 6 are respective enlarged views illustrating structural details of how certain transverse elements are joined to lengthwise elements in the preferred embodiments.

Referring now to FIG. 3, it will be seen how in the preferred embodiment the exemplary full width transverse truss 300 (intended to be structurally similar to the trusses 124) comprises an elongate chord 302 of a length corresponding to the total width of the floor assembly 100 or 200. Such a chord 302 preferably is made of wood in a length in the range 10 ft.—20 ft., and a cross-section preferably about 2 in.×6 in. It may be desirable to form dadoed cuts preferably not more than ⅝ in. deep and preferably not closer than 3 in. from the nearest point of either of I-section steel beams 106, 108. Such dadoed cuts 304 may be used to accommodate support boards for providing additional support and stiffness to the floor covering to be applied thereover.

Figure 4:
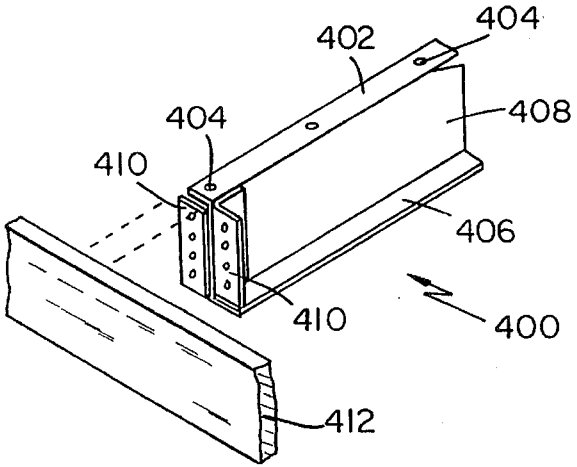

I-section steel beams 106, 108 are preferably separated by a distance approximately 8 ft. apart. Just above the bottom flanges of longitudinal support beams 106, 108, each of the full width transverse trusses includes a C-section steel structural channel element 306 which may be welded or bolted at its ends to the respective upper surfaces of the flanges of beams 106, 108. Inclined bracing members 308, 308 may be welded or bolted in place as illustrated in FIG. 3 to ensure stiffness and strength in the transverse interconnection thus provided between I-beams 106, 108. As best seen in FIG. 3, on the side of truss 300 adjacent to longitudinal side wall 110 there is preferably provided a sheet-metal cross member 400 shown in greater detail in FIG. 4. Cross member 400 has an upper flange 402 which is affixed to an under surface of chord 302, e.g., by driving nails, screws or the like through apertures 404 provided therein. Cross member 400 also has a lower flange 406 parallel to upper flange 402, and a vertical web 408 therebetween. The ends of lower flange 406 and vertical web 408 may be attached to the corresponding immediately adjacent surfaces of I-support beam 106 by welding, bolting, or in any other suitable manner. At the end immediately adjacent to rail 110, cross member 400 is provided with vertical, longitudinally-oriented flanges 410, 410 affixed to a laminated beam 412, the respective dimensions being selected such that an outer vertical surface of laminated beam 412 is in the same vertical plane as the end of top chord 302 and allows affixation of laminated board 412 directly to an inside surface of side wall 110.

At the other end of full width transverse truss 300 there is provided a generally similarly structured, mirror-image type cross member 500 having an upper flange 502 provided with apertures 504, by which it is connected to an under surface of top chord 302, a bottom flange 506 and a vertical flange 508 which may be connected to corresponding immediately adjacent surfaces of I-support beam 108 by welding, bolting, or the like. Truss member 500 is also provided with end flanges 510, 510 formed with apertures 512 through which conventional nails, screws or the like may be applied or connected to inside surfaces of longitudinal girder beam 122.

As will be appreciated, when reinforcement beam 210 is provided as part of the reinforcement of girder beam 122 and stairwell opening 202, flanges 510 would be affixed thereto for reinforced trusses 206, 208 and immediately adjacent full width trusses 124 as previously discussed.

Figure 6:
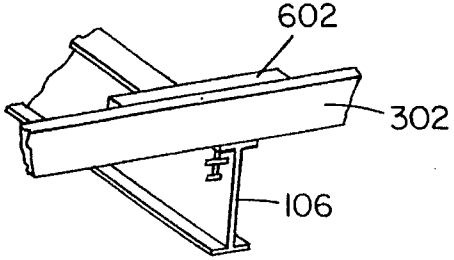
Figure 7:
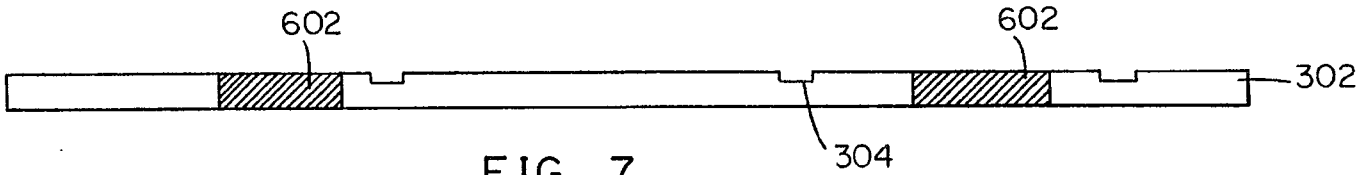
FIG. 7 is a vertical side elevation view of a transverse chord incorporated at an upper portion of a truss the floor assembly according to the preferred embodiments.

As best seen in FIG. 6, where top chord 304 passes over the top flanges of I-beams 106, 108, it is preferable to affix shear blocks 602 to provide reinforcement and additional stiffness. Shear blocks 602 may be affixed to top chord 302 with the corresponding truss 124 by nails or the like. See also FIG. 7 which clearly indicates that shear blocks 602 have a height corresponding to that of top chord 302 so that any flooring placed thereabove may be affixed to both the chord 302 and shear blocks 602 to thereby further stiffen and make the entire unified structure more rigid.

Figures 8, 9, 10, 11, 12, 13:
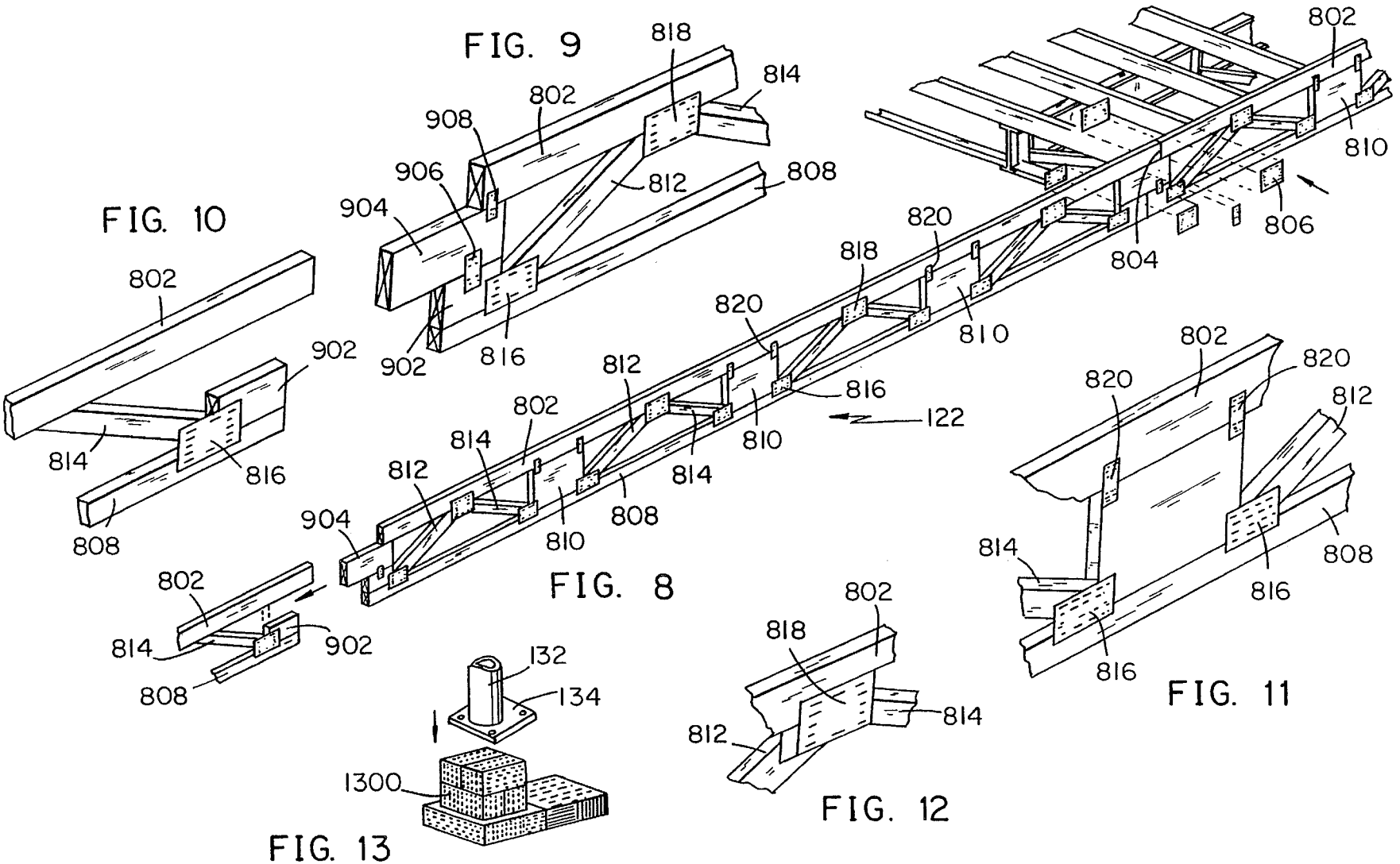
FIG. 8 is a partially-exploded perspective view to illustrate details of an elongate girder beam and the manner of its disposition relative to transverse elements in the preferred embodiments.
FIGS. 9, 10, 11 and 12 are enlarged views of various junctions between cooperating elements in the elongate wooden girder beam per FIG. 8.
FIG. 13 is a perspective view of an exemplary footing for a support post of a type suitable for supporting the unified floor assembly of this invention at locations away from supporting walls.

Details of longitudinal girder beam 122 are best understood with reference to FIG. 8. Girder beam 122 comprises a top elongate chord 802. If the length of the corresponding floor assembly, i.e., 100 or 200, is in excess of about 20 ft., it may not be possible to provide a single element continuous top chord 802. Separate cooperating or linear elements 802, 802 may thus be butted to each other at interfaces 804 and affixed to each other thereat by conventional nail plates such as 806.

Girder beam 122 also has an elongate longitudinally-oriented bottom chord 808 spaced from top chord 802 by spacer blocks 810 and cross bracing elements 812, 814. Various conventional nail plates, e.g., 816,818 and 820 may be employed as needed to affix these elements to each other in a strong and permanent manner.

The above-described construction of longitudinal girder beam 122 ensures that there are numerous openings therethrough to accommodate assorted utility elements, e.g., ventilation ducting 250 connectable to a floor register 252, pipes, wires, etc. The provision of these openings also reduces the total weight while the spacer blocks and bracing elements combine to provide the desired stiffness, strength and overall flexibility needed to accommodate the shock loads which the floor assembly 100 or 200 is expected to encounter during transportation.

There is yet another aspect of girder beam 122 which provides singular advantages in longitudinally combining and connecting successive floor assemblies 100 or 200. This feature is best understood with reference to FIGS. 8, 9 and 10. As best seen in FIG. 9, at one end of girder beam 122 top chord 802 ends short relative to the corresponding adjacent end of bottom chord 808. Instead of a single spacer block 810, there are provided two cooperating spacer blocks 902 and 904, of which spacer block 904 is longer and projects beyond the aligned ends of spacer block 902 and lower chord 808. The various spacer blocks and top and bottom chords of the same thickness, as best seen in FIGS. 8, 9 and 10, and are interconnected to each other by the use or conventional nail plates 906, 908. By the just-described structure, there is provided at one end of girder beam 122 a male projecting portion of spacer block 904.

At the opposite end of the same girder beam 122 an opening is left between top chord 802 and an upper surface of spacer block 902 which ends in alignment with bottom chord 808. Furthermore, top chord 802 extends beyond the immediately adjacent end of bottom chord 808 by an amount which corresponds to the longitudinal spacing apart between the ends of top chord 802 and bottom chord 808 at the opposite end of girder beam 122. There is thus created a female end to girder beam 122 shaped, sized and aligned to closely receive therein a corresponding male end of a girder 122 of the same thickness and belonging to another floor assembly 100 or 200 longitudinally aligned therewith.

Then, as indicated at the left-hand end of FIG. 8, when two longitudinal girder beams 122, 122 each belonging to a respective longitudinally aligned floor assembly are moved into engagement with each other the male and female elements fit closely and being of the same thickness may be affixed to each other by additional conventional nail plates (not shown for simplicity). When two floor assemblies are thus cooperatively connected to each other by their respective longitudinal girder beams 122, the flooring applied thereof may be disposed to further consolidate and unify the two floor assemblies by additional connecting nail plates or the like.

As persons of ordinary skill in the art will appreciate, in FIG. 2 there is illustrated and made clear how two floor assemblies, one of which may optionally have a stairwell, may be disposed to be unified at their immediately adjacent longitudinal sides. In similar manner, FIGS. 8–10 illustrate and make clear how to interconnect the respective longitudinal girder beams 122 of two cooperating floor assemblies in a longitudinal cooperative relationship. Persons of ordinary skill in the art can be expected to explore and consider other variations, e.g., employing three floor assemblies in a cooperative manner so as to create a L-shaped unified floor therefrom. Such variations are intended to be comprehended within the present invention.

FIGS. 11 and 12 indicate somewhat enlarged views of the above-discussed aspects, i.e., the manner in which spacer block 810, top chord 802, bottom chord 808, and inclined bracing elements 812 and 814 are interconnected to each other by nail plates 816, 818 and 820.

FIG. 13 is a perspective view illustrating an exemplary masonry or concrete-block footing structure which may be formed to support the lowermost end of a support post such as 132 if no preexisting floor 136 is available as in the structure illustrated in FIG. 1. Other alternative structures to accomplish this purpose may be considered to suit particularized needs. The goal is to ensure that there is sufficient load-bearing surface available beneath support post 132 to adequately support the anticipated weight to be received thereon from the floor assembly supported thereover, with an adequate factor of safety taken into account.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A modular unified floor assembly having a longitudinal axis, comprising:

longitudinal first interior beam means, parallel to the longitudinal axis, for providing interior support;

longitudinal second interior beam means, parallel to the longitudinal axis and located on an opposite side thereof relative to said first interior beam means, for providing interior support;

exterior longitudinal rail means, disposed parallel to the longitudinal axis for providing longitudinal support and defining a first longitudinal perimeter portion of the floor assembly;

a longitudinal girder beam, disposed parallel to the longitudinal axis and on an opposite side of the floor assembly relative to the rail means, for providing longitudinal support and defining a second longitudinal perimeter portion of the floor assembly, the girder beam having numerous openings formed to accommodate utility elements within the floor assembly and to reduce weight; and a plurality of transverse truss means each connected to said rail means at a first end, to said girder beam at a second end, and to said first and second interior beam means respectively intermediate said first and second ends.

2. The floor assembly according to claim 1, wherein:

said second interior beam means comprises first and second collinear portions having respective adjacent ends separated by a first gap corresponding to a longitudinal side of a stairwell formed therebetween; and said plurality of transverse truss means includes a shortened truss means extending from a first end connected to said rail means, past said first interior beam means and connected thereto, and to a second end intermediate the first and second interior beam means, said second end being separated from said girder beam by a second gap corresponding to a transverse side of said stairwell disposed therebetween.

3. The floor assembly according to claim 2, further comprising:

stairwell perimeter means comprising transverse reinforcement members respectively connected to a pair of said plurality of transverse truss means respectively connected to said adjacent ends of said first and second collinear portions of said second interior beam means, a first longitudinal reinforcement member connected to said second end of said shortened truss means and to said transverse reinforcement members, and a second longitudinal reinforcement member connected to said girder beam and to said transverse reinforcement members.

4. The floor assembly according to claim 3, wherein:

said girder beam has a female end formed to have a gap of selected width and length and a male end formed to have an extension corresponding to said gap in width and length, whereby the male end of one floor assembly is fitted and connected to the female end of another similar floor assembly to create a longitudinally extended floor assembly combination.

5. The floor assembly according to claim 4, wherein:

each of said transverse truss means each comprises a transverse top chord which is disposed above said first and second interior beam means and has a first upper surface;

said rail means comprises a longitudinal top rail having a second upper surface; and said girder beam comprises a longitudinal top chord having a third upper surface;

wherein said first, second and third surfaces are disposed to be coplanar to provide unified support for mounting a floor thereabove.

6. The floor assembly according to claim 5, wherein:

each of said transverse truss means comprises a bottom member extending between and connected to said first and second interior beam means and disposed below the corresponding transverse top chord to define a space therebelow.

7. The floor assembly according to claim 6, further comprising:

a first utility element selectively extended longitudinally of the floor assembly through selected ones of said plurality of truss means via said spaces respectively defined therein.

8. The floor assembly according to claim 7, further comprising:

a second utility element extended between top chords of a pair of adjacent transverse truss means and over one of said first and second interior beam means.

9. The floor assembly according to claim 8, wherein:

said first and second utility elements are cooperatively connected to each other.

10. The floor assembly according to claim 9, wherein:

at least one of said first and second utility elements comprises one of a ventilation duct, a water-conveying pipe, electrical power wiring, and a telephone line.

11. The floor assembly according to claim 1, wherein:

said girder beam has a female end formed to have a gap of selected thickness, width and length and a male end formed to the same thickness and to have an extension corresponding to said gap in width and length, whereby the male end of one floor assembly is fitted and connected to the female end of another similar floor assembly to create a longitudinally extended floor assembly combination.

12. The floor assembly according to claim 1, wherein:

each of said transverse truss means comprises a transverse top chord which is disposed above said first and second interior beam means and has a first upper surface;

said rail means comprises a longitudinal top rail having a second upper surface; and said girder beam comprises a longitudinal top chord having a third upper surface;

wherein said first, second and third surfaces are disposed to be coplanar to provide unified support for mounting a floor thereabove.

13. The floor assembly according to claim 12, wherein:

each of said transverse truss means comprises a bottom member extending between and connected to said first and second interior beam means and disposed below the corresponding transverse top chord to define a space therebelow.

14. The floor assembly according to claim 13, further comprising:

a first utility element selectively extended longitudinally of the floor assembly through selected ones of said plurality of truss means via said spaces respectively defined therein.

15. The floor assembly according to claim 14, further comprising:

a second utility element extended between top chords of a pair of adjacent transverse truss means and over one of said first and second interior beam means.

16. The floor assembly according to claim 15, wherein:

said first and second utility elements are cooperatively connected to each other.

17. The floor assembly according to claim 15, wherein:

at least one of said first and second utility elements comprises one of a ventilation duct, a water-conveying pipe, electrical power wiring, and a telephone line.

18. A supported floor structure comprising cooperatively connected first and second unified floor assemblies according to claim 1, and further comprising:

support means respectively supporting said first and second unified floor assemblies so that each is horizontal and at one level, the second unified floor assembly being disposed with the girder beam thereof immediately adjacent to the girder beam of the first unified floor assembly and connected thereto, wherein said support means includes support elements commonly supporting the connected girder beams.

19. The floor structure according to claim 18, wherein:

at least one of said first and second unified floor assemblies is one in which said second interior beam means comprises first and second collinear portions having respective adjacent ends separated by a first gap corresponding to a longitudinal side of a stairwell formed therebetween, and wherein said plurality of transverse truss means includes a shortened truss means extending from a first end connected to said rail means, past said first interior beam means and connected thereto, and to a second end intermediate the first and second interior beam means, said second end being separated from said girder beam by a second gap corresponding to a transverse side of said stairwell disposed therebetween.

20. The floor assembly according to claim 1, wherein:

said first and second interior beam means comprise respective steel I-section beams.

* * * * *